US007992366B2

(12) United States Patent
McCarthy

(10) Patent No.: US 7,992,366 B2
(45) Date of Patent: Aug. 9, 2011

(54) DALLY HORN WRAP

(76) Inventor: John N. McCarthy, Von Ormy, TX (US)

( * ) Notice: Subject to any disclaimer, the term of this patent is extended or adjusted under 35 U.S.C. 154(b) by 0 days.

(21) Appl. No.: 12/288,985

(22) Filed: Oct. 24, 2008

(65) Prior Publication Data

US 2010/0101194 A1 Apr. 29, 2010

(51) Int. Cl.
*B68C 1/02* (2006.01)

(52) U.S. Cl. ..... 54/44.1

(58) Field of Classification Search ..... 54/44.1, 54/1, 44.2, 44.3, 44.4, 44.5, 44.6, 44.7; 119/712, 119/805, 795, 797, 798; *B68C 1/14, 1/02; A01K 27/00*

See application file for complete search history.

(56) References Cited

U.S. PATENT DOCUMENTS

| | | | | | |
|---|---|---|---|---|---|
| 7,507 | A * | 7/1850 | Fisher | 54/44.4 |
| 443,241 | A * | 12/1890 | Northrup | 54/44.1 |
| 3,196,595 | A * | 7/1965 | McKeen, Jr. | 54/44.1 |
| 3,707,827 | A * | 1/1973 | Strang | 54/44.1 |
| 4,164,834 | A * | 8/1979 | Christensen | 54/46.1 |
| 4,608,812 | A * | 9/1986 | Willson | 54/46.1 |
| 4,942,721 | A * | 7/1990 | Van Scoyk | 54/46.1 |
| 5,212,934 | A * | 5/1993 | Brown | 54/46.1 |
| 5,329,671 | A * | 7/1994 | Walczak et al. | 24/20 R |
| 5,740,764 | A * | 4/1998 | Jacobsen | 119/798 |
| 6,145,478 | A * | 11/2000 | Boyd et al. | 119/725 |
| 6,279,203 | B1 * | 8/2001 | Hundley et al. | 24/16 PB |
| 6,763,650 | B1 * | 7/2004 | Snow | 54/71 |
| 2006/0107626 | A1 * | 5/2006 | Wilson | 54/44.1 |
| 2006/0248863 | A1 * | 11/2006 | Gorman | 54/44.1 |
| 2009/0000568 | A1 * | 1/2009 | Titcomb et al. | 119/798 |

FOREIGN PATENT DOCUMENTS

| | | | |
|---|---|---|---|
| FR | 2669914 | A1 * | 6/1992 |
| GB | 2375700 | A * | 11/2002 |

* cited by examiner

*Primary Examiner* — Son T. Nguyen

(57) ABSTRACT

The present invention is a wrap designed to protect the saddle horn when a lariat rope is dallied around it and pressure applied, as when roping cattle in the sports of team and calf roping. The horn wrap consists of a strap having desired elasticity and durability, as well as a sufficient coefficient of friction. The horn wrap can have one or two apertures at the tips which can be pulled over the saddle horn and act to attach the horn wrap to the saddle horn. Generally anticipated to be in a generally bell shape, the attachment pieces act to protect the saddle pommel near the base of the saddle horn. The horn wrap may be beveled near its edges so as to allow for smooth layers on the saddle horn which can increase the contact of the rope to the saddle horn to increase the friction resisting the dally sliding when weight is applied to the rope.

11 Claims, 8 Drawing Sheets

DALLY HORN WRAP

BACKGROUND OF THE INVENTION

1. Field of the Invention

Applicants' invention relates to a device for protecting the saddle horn and swells of a saddle. More particularly, it relates to a wrap designed to protect the saddle horn and swells when a lariat rope is dallied around it and pressure applied, as when roping cattle in the sports of team and calf roping.

2. Background Information

Roping cattle from horseback is a historical process that many recognize. Branding and doctoring the cattle necessitated that cowboys capture the animals, and early ranches where this process completed without the benefit or aid or pens and specialized shoots necessitated a very specific skill of the cowboys, as well as necessitating specialized equipment. Part of this specialized equipment included development of the western saddle. These skills and equipment in practice in many places yet today.

Many people are also familiar with the transition that was made of the various roping styles to rodeo events. One of the roping styles that found its way to the rodeo arena, and continues to grow in popularity, is the sport of team roping. Team roping, as its name implies, is an event that is completed by two ropers. The first roper, called the header, ropes the animals first and either ropes the animal around the neck or, more preferably, around the horns. The second roper, called the healer, waits for the header to slow the animal and turn the animal at an approximate 90-degree angle before roping the animal's hind legs.

In a typical rodeo run, the steer is placed in a starting gate called a shoot. Behind the shoot is a three-sided area called the box in which the header and healer start on their horses. Traditionally, the header and healer were in a double-box to the rear and on the right side of the steer. However, in the last few decades, it has become most common that the header starts in a box to the rear and on the left side of the steer, while the healer starts in a box to the rear and on the right side of the steer. The header calls for the steer to be released by nodding his head or otherwise indicating his readiness. The steer is given a designated head start, called a score, and the ropers (or at least the header) are required to wait in the box until the steer reaches a certain point, at which time they can leave the box in pursuit of the steer.

Once the ropers leave the box, their horses chase the steer an attempt to close the distance between the animals. As the header gets closer to the steer, he generally attempts to arrive to the rear of the animal close enough to rope it and slightly to its left. Meanwhile, the healer rates his horse back and to the right of the steer such that he is ready to close the gap after the header ropes, but also he can attempt to help keep the steer from ducking to the right.

Once the roper has gotten close enough to the steer to rope, he ropes the steer around the horns or neck and pulls his slack to tighten the loop around the steer's horns. He then takes a couple of wraps around his saddle horn with the free end of the rope (the "dally") so that the steer is effectively attached by the rope to the saddle of the horse and rider. The header then signals his horse to slow which also slows the steer slightly. Then he turns his head horse off to the left at approximately a 90-degree angle such that the steer is then pulled to the left as well. Once the steer changes directions, the healer is then allowed to take his throw at the heels of the steer. He attempts to rope both hind feet, although roping one hind foot is a legal catch as well, albeit one with a penalty. Once the healer ropes the hind feet, he dallies his rope as well and stops his horse. The header continues until he takes the slack out of his rope, then turns his horse to face the steer, leaving the steer immobilized between the two horses.

The western saddle was traditionally, and is still, used on working horses on cattle ranches throughout the United States, particularly in the west. They are the "cowboy" saddles familiar to movie viewers and rodeo fans. The western saddle is characterized as allowing great freedom of movement to the horse, and security to the rider and strong control of the horse. One extremely functional item is virtually always identified with the western saddle—the saddle "horn."

As is evident from the description of team roping above, the saddle horn is integral to roping cattle, whether it is in team roping as described above, or in branding, doctoring, tie-down calf roping, or other instances in which an animal is roped and snubbed to the roper's saddle. The saddle horn allows cowboys to control cattle by use of a rope around the neck, horns, or legs of the animal, tied or dallied around the horn. A "dally" is the term for when the rope is wrapped around the horn, without a knot, to cinch the bovine to the saddle. The free end of the rope is wrapped around the horn and held by the cowboy. The cowboy can then hold the free end tight or let it slide around the horn to best control the cow. Given that the horn must thus accept the weight of both the horse and steer, the horn is subject to extreme pressure. Likewise, as the dally is tighten, or is allowed to slide, there is an enormous amount of friction developed between the rope and the saddle horn.

The saddle horn is generally covered with leather or rawhide and is susceptible to being damaged by the friction. As a result, cowboys often wrap their saddle horns with protective material that can be disposed of as it becomes damaged by the friction, removed, and replaced.

Probably the most common and popular of modern horn wraps are strips of rubble inner tube, where the strips are cut perpendicular to the tube so that a circle of rubber stripping is obtained. The strip is then pulled and stretched about the saddle horn until it is tight and covers the horn. It is then tied onto itself.

Other horn protective materials have been developed, such as the saddle horn friction fitting described by Jones in U.S. Pat. No. 6,062,006. The '006 patent describes a hollow cylindrical fitting piece of rubber sized with an inner diameter sufficiently undersized in relation to the saddle horn that it achieves a tight, tensioned fit over the saddle horn. In practice however, in order for the single piece unit to be sufficiently tight to keep from turning when under the stress of a dally, it is so small that it is extremely difficult to install on the saddle horn. Likewise, when it needs to be replaced, it is very hard to remove, or it must either be cut off, creating the possibility of damaging the saddle horn.

SUMMARY OF THE INVENTION

The present invention consists of a horn wrap. The present invention provides a novel apparatus that will protect the saddle horn.

The present invention also provides for a horn wrap having the following beneficial characteristics:

a. even, smooth layers
b. wrap is reversible
c. increased contact with rope due to uniformity
d. protects pommel at base of saddle horn
e. easier application than traditional wraps and methods
f. increased useful life g. variable wrap width
h. wrap tightens when dally applied

DETAILED DESCRIPTION OF THE PREFERRED EMBODIMENT

Referring to the figures in which like reference features indicate corresponding elements throughout the several views.

| Ref. No. | Element |
|---|---|
| 100 | Horn wrap |
| 10 | Strap |
| 10a | Strap first end |
| 10b | Strap second end |
| 12 | Strap bevel |
| 14 | Shoulder |
| 16 | Strap center |
| 18 | Strap edge |
| 20a | First aperture |
| 20b | Second aperture |
| 22a | First bell attachment piece |
| 22b | Second bell attachment piece |
| 24a | First bell curvature axis |
| 24b | Second bell curvature axis |
| 26a | First tip |
| 26b | Second tip |
| 28a | First straight attachment piece |
| 28b | Second straight attachment piece |
| 30 | Saddle |
| 32 | Horn cap |
| 34 | Horn |
| 36 | Gullet Slot |
| 38 | Seat |
| 40 | Pommel or Swells |
| 42 | Gullet |
| 44 | Rope |
| 46 | Cantle |
| A-A | Horn wrap cross-sectional view |
| B | Livestock rope end |
| C | Rider rope end |
| D | Horn wrap binding direction |

Figure 1:
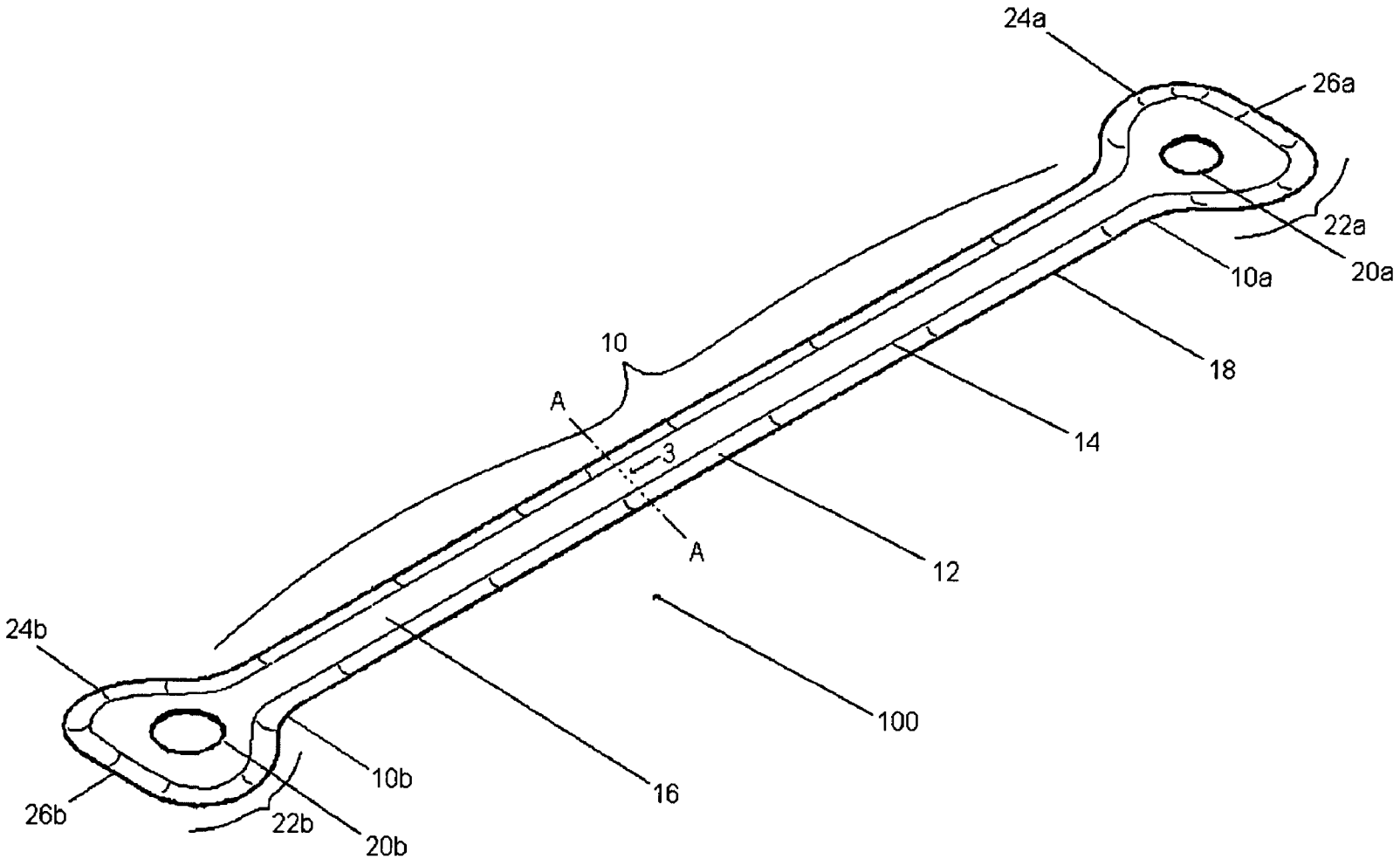
FIG. 1. is a perspective view of the present invention.

Attention is first directed to FIG. 1 which illustrates Attention is first directed to FIG. 1, which illustrates a first embodiment of the horn wrap 100. The horn wrap 100 consists generally of a strap 10 having a first end 10*a* and a second end 10*b*, and a first tip 26*a* and a second tip 26*b*. The strap 10 is an elongated piece of material that may be made from a number of materials which exhibit desired characteristics. The desired characteristics include elasticity, and durability, as well as a sufficient coefficient of friction.

In its first embodiment, the horn wrap 100 incorporates first and second apertures 20*a* and 20*b* at the first and second tips 26*a* and 26*b*. Additionally, the strap has a first width, while the first and second tips 26*a* and 26*b* may be formed into a first bell attachment piece 22*a* and a second bell attachment piece 22*b*. The first and second bell attachment pieces 22*a* and 22*b* have broadened, second and third widths as compared to the first width of the strap 10. While a first embodiment of the first and second bell attachment pieces 22*a* and 22*b* have been described herein as bell shaped, it is anticipated that the attachment pieces may be any shape that provides increased width as compared to the strap 10, as such the attachment pieces could be manufactured in any of generally circular, oval, bell, square, rectangular, or other shapes.

In generally the center of the first and second bell attachment pieces 22*a* and 22*b* are first and second apertures 20*a* and 20*b*. The first and second apertures 20*a* and 20*b* are sized such that they fit around the saddle horn 34. Further, the elasticity of the horn wrap 100 and the first and second bell attachment pieces 22*a* and 22*b* allows the first and second apertures 20*a* and 20*b* to stretch over the horn cap 32.

The strap 10 has a strap center 16 of a desired thickness. At both sides of the strap center 16 is a shoulder 14 and a strap edge 18. The thickness of the strap 10 can narrow from the shoulder 14 to the strap edge 18. This beveling allows the horn wrap 100, when the edges 18 of the horn wrap 100 are lapped over themselves to be a relatively smooth surface presented on the horn 34.

The first and second bell attachment pieces 22*a* and 22*b* are integrated into the ends of the strap 10, and are designed for attachment to the horn 34 or to another portion of the saddle 30.

Figure 2:
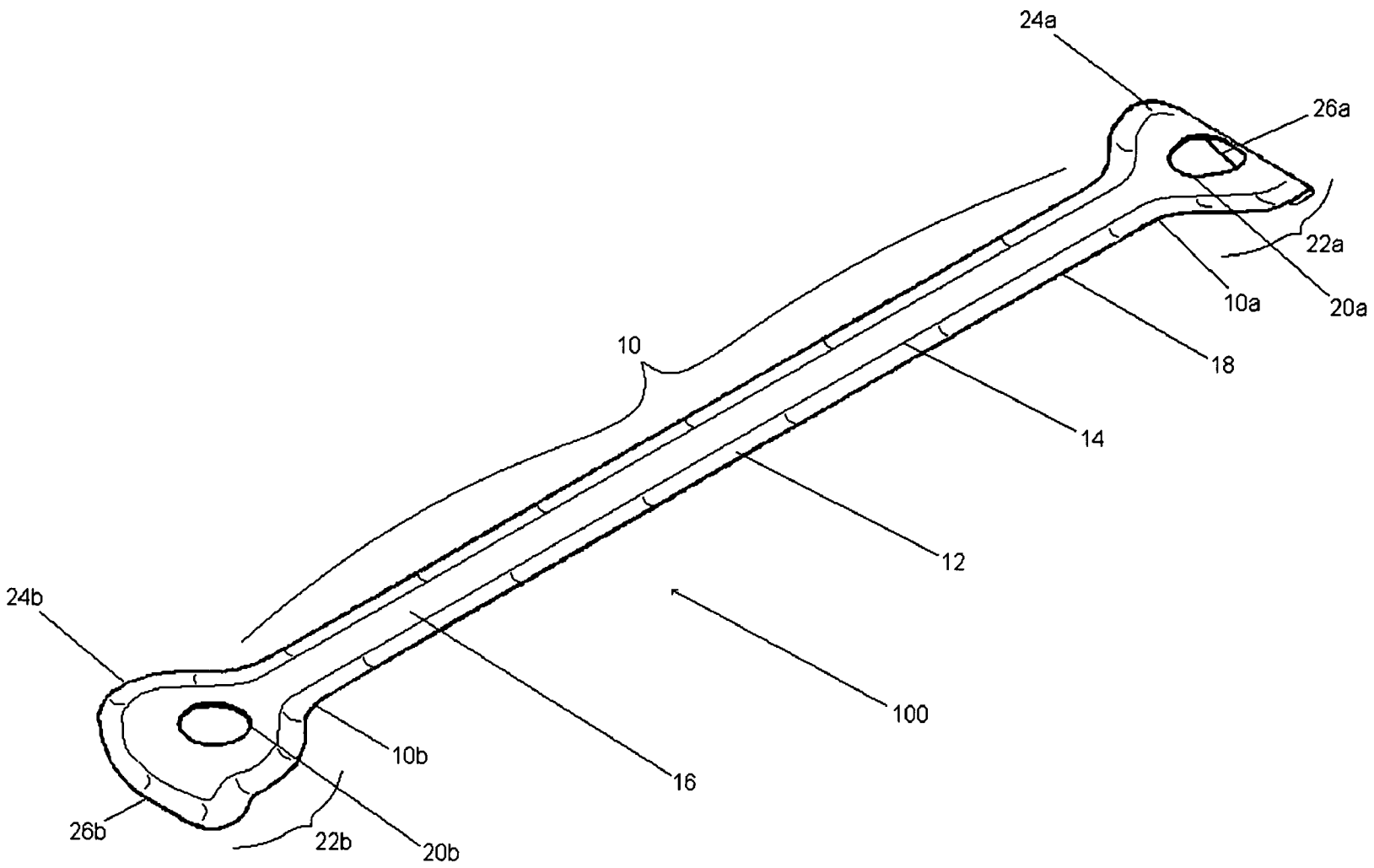
FIG. 2. is a perspective view of a second embodiment of the present invention.

FIG. 2 illustrates a second embodiment of the horn wrap 100. Many of the same elements as in FIG. 1 are evident. However, it is anticipated that the horn wrap 100 may be shaped so as to have the first and second bell attachment pieces 22*a* and 22*b* incorporate a curvature along the first and second bell curvature axis 24*a* and 24*b*. This curvature of the first and second bell attachment pieces 22*a* and 22*b* provide for attachment of the horn wrap 100 over the horn 34 to fit closely against the pommel 40.

Figure 3:
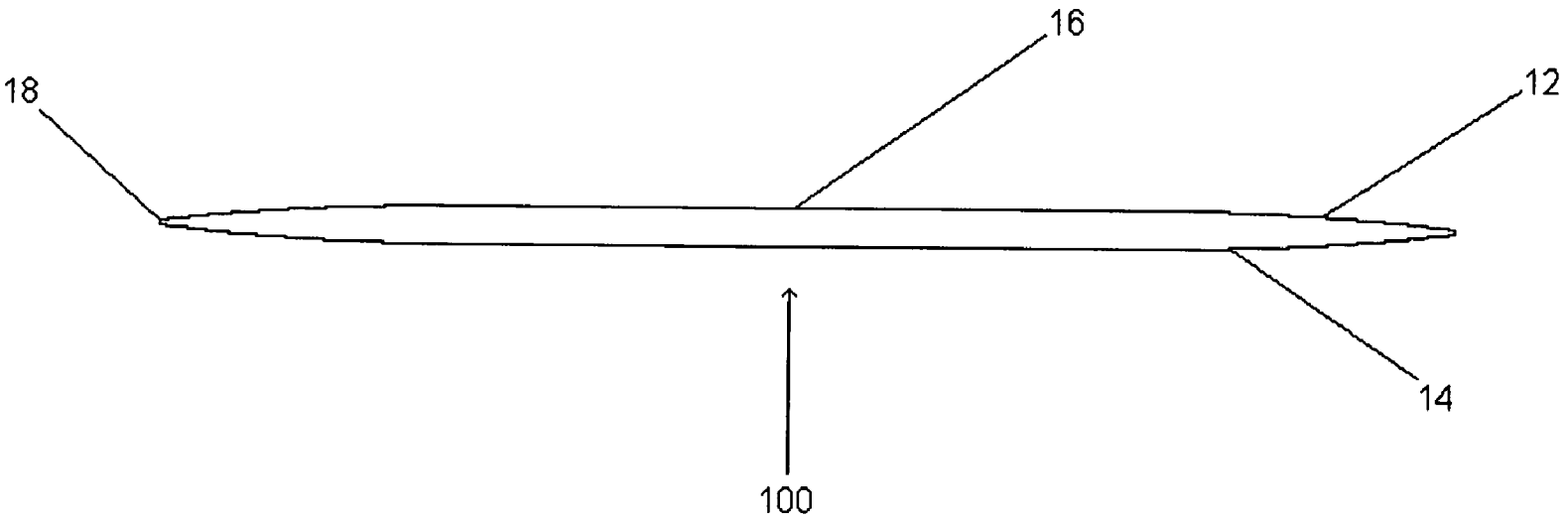
FIG. 3. is a sectional view of the present invention taken along line A-A in FIG. 1.

FIG. 3 illustrates a sectional view of the horn wrap 100 at the point as indicated in FIG. 1 along axis A-A. This figure illustrates the greater thickness in the strap center 16 portion of the strap 10, as well as the beveling of the strap 10 from the shoulder 14 to the strap edge 18. The beveling is referred to as the strap bevel 12. It is anticipated that the strap bevel 12 will be incorporated in to the strap 10 on both sides of the center axis. This will allow for the horn wrap 100 to be applied in either direction and with either side out from the horn 34.

Figure 4:
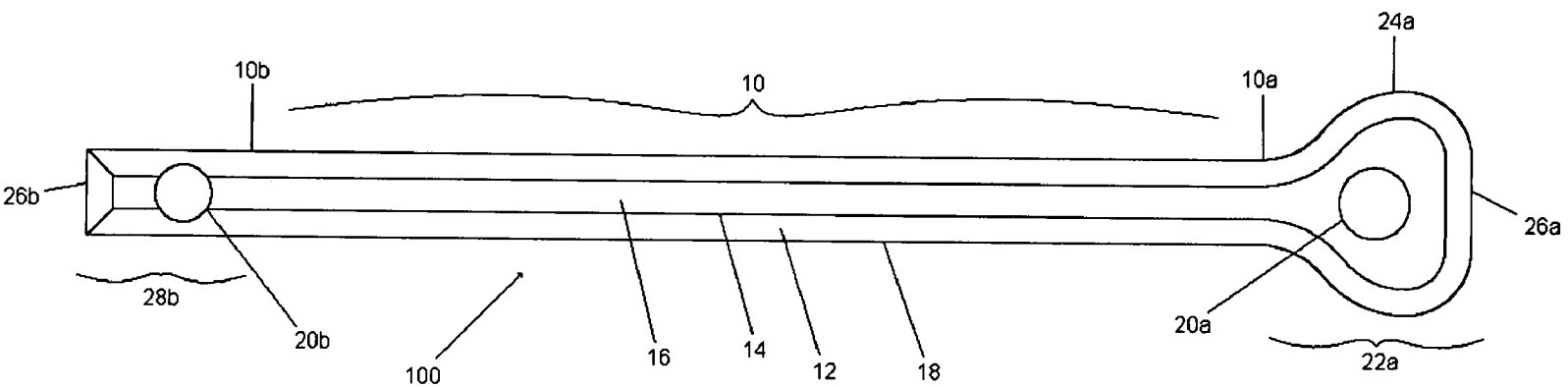
FIG. 4. is a top view of a third embodiment of the present invention.

FIG. 4 illustrates another embodiment of the horn wrap 100. In this embodiment, the horn wrap 100 incorporates first bell attachment piece 22*a* along with a second straight attachment piece 28*b*. It is anticipated that the shape of the first bell attachment piece 22*a* would help protect the pommel 40 from friction and scoring applied by the rope 44. However, it is also anticipated that the horn wrap 100 would act to protect the horn 34 regardless of whether the attachment pieces are straight or bell-shaped. Having a single bell attachment piece 22*a* as shown in this figure does allow for protection of the pommel 40 without having a bell-shaped attachment piece at both ends of the strap 10.

Figure 5:
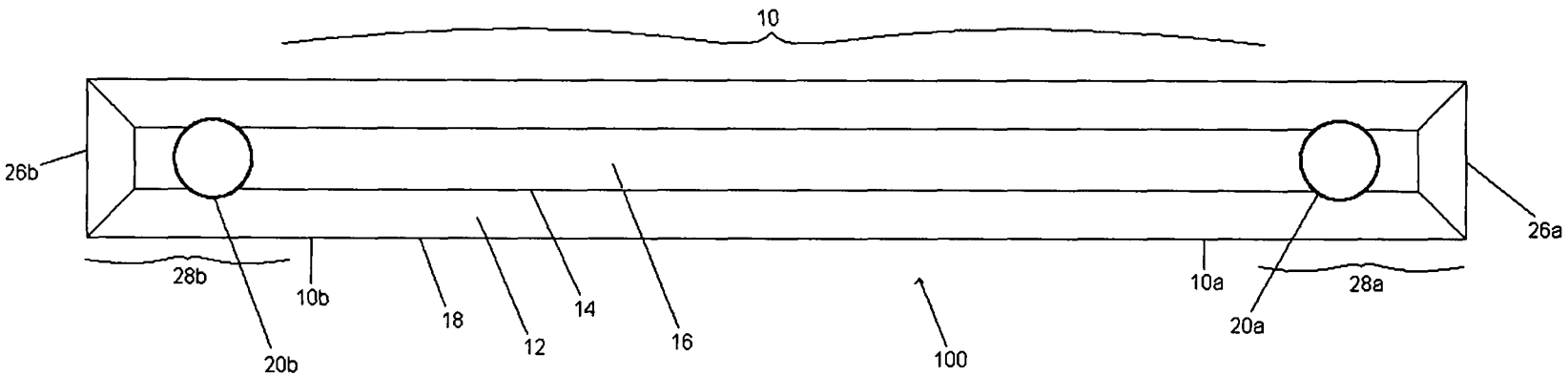
FIG. 5. is a top view of a fourth embodiment of the present invention.

FIG. 5 is another embodiment of the horn wrap 100. In this figure, the horn wrap 100 is shown with first and second straight attachment pieces 28*a* and 28*b*. In this embodiment, the strap 10 has a the first width, while the first and second straight attachment pieces 28*a* and 28*b* have second and third widths that are equal to the first width.

Figure 6:
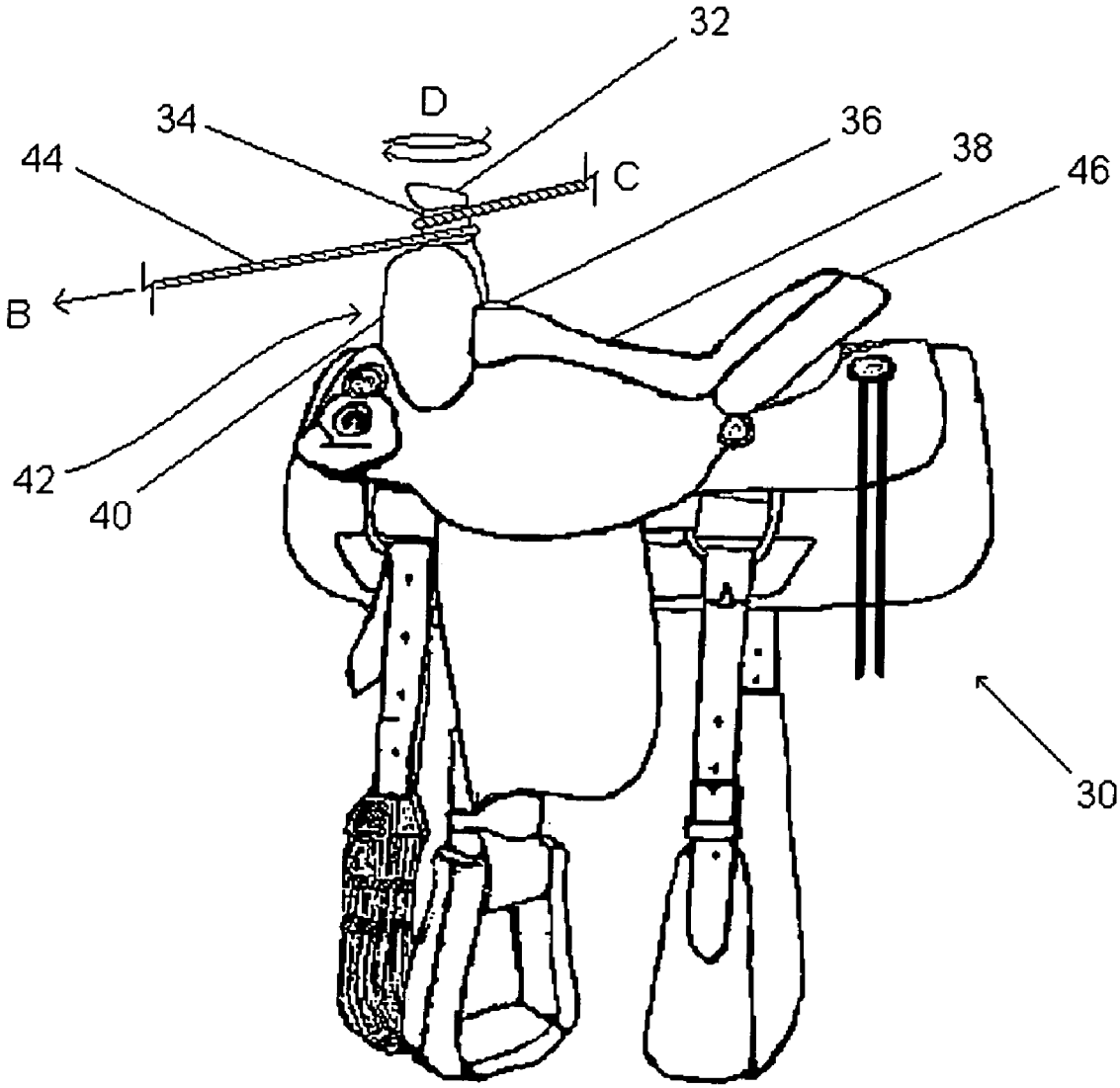
FIG. 6. is a side elevation view of a saddle.

FIG. 6 illustrates a saddle 30 having a horn 34 topped by a horn cap 32 at the front of the saddle 30. The horn 34 is set atop a pommel 40 (also referred to as the swells) which is at the front of the seat 38. The back of the seat 38 is the cantle 46. The swells 40 are somewhat curved on the underneath creating an open area referred to as the gullet 42. Where the seat 38 attaches to the pommel 40, an opening is left near the center of the seat 38 where it attaches at the front to the pommel 40. This aperture is referred to as the gullet slot 36.

In most instances when a rope 44 is dallied about the horn 34, it is done so in a counterclockwise direction. In this figure, the end of the rope 44 that is attached to the animal is at point B while the end of the rope 44 held by the rider is at point C. When weight is applied at the end of rope 44, torque and friction is applied in a clockwise direction. In any case, torque and friction are applied in a direction opposite that of the direction of the dally taken by the rider. As stated above, it is typical that dallies are taken in a counterclockwise direction because most ropers are right-handed and right-handed ropers dally counterclockwise.

In order to best counteract the torque and friction applied to it by the weight, the horn wrap 100 is applied to the horn 34 in a clockwise direction as indicated by arrow D. Applying the horn wrap 100 in the direction D, which is the same direction as the direction of torque as applied by the rope 44 results in the horn wrap 100 tightening about the horn 34 when torque and friction are applied by the rope 44.

Figure 7A:
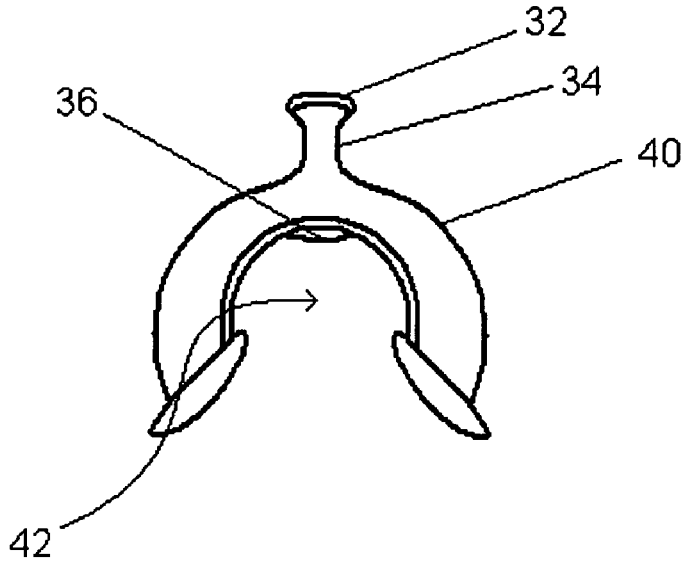
FIG. 7*a*. is a front elevation view of a saddle.
Figure 7B:
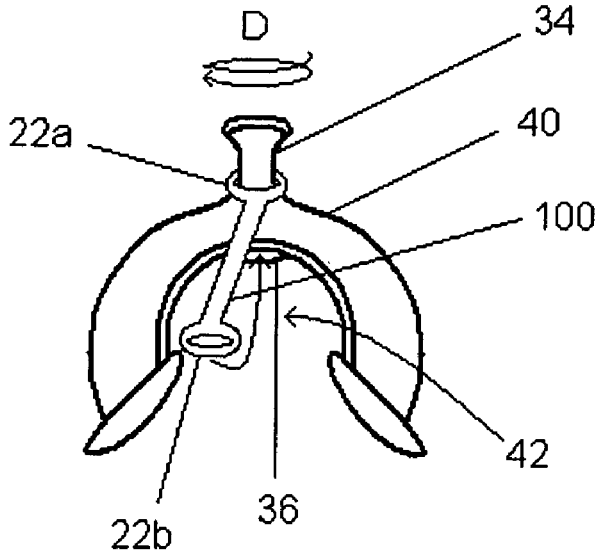
FIG. 7*b*. is a front elevation view of a saddle, and illustrating the present invention being applied to the saddle horn.

FIG. 7A is a front view of the saddle 30. It better illustrates the open area of the gullet 42 as circumscribed by the pommel 40. It also indicates the general positioning of the horn 34, horn cap 32 and gullet slot 36.

In order to apply the horn wrap 100, the first bell attachment piece 22*a* (in a first embodiment of the horn wrap 100) is applied about the horn 34. The first tip 26*a* of the horn wrap 100 is thus anchored to the horn 34. The second tip 26*b* of the horn wrap 100 can then be extended from the horn 34, wrapped around the pommel 40 and through the gullet slot 36. The horn wrap 100 can then be wrapped about the horn 34. Once again, arrow D indicates the direction of the anticipated wrapping of the horn wrap 100. However, the horn wrap 100 can be wrapped in either direction about the horn 34, but should be wrapped in the direction opposition that the rider intends to apply the dally.

Figure 7C:
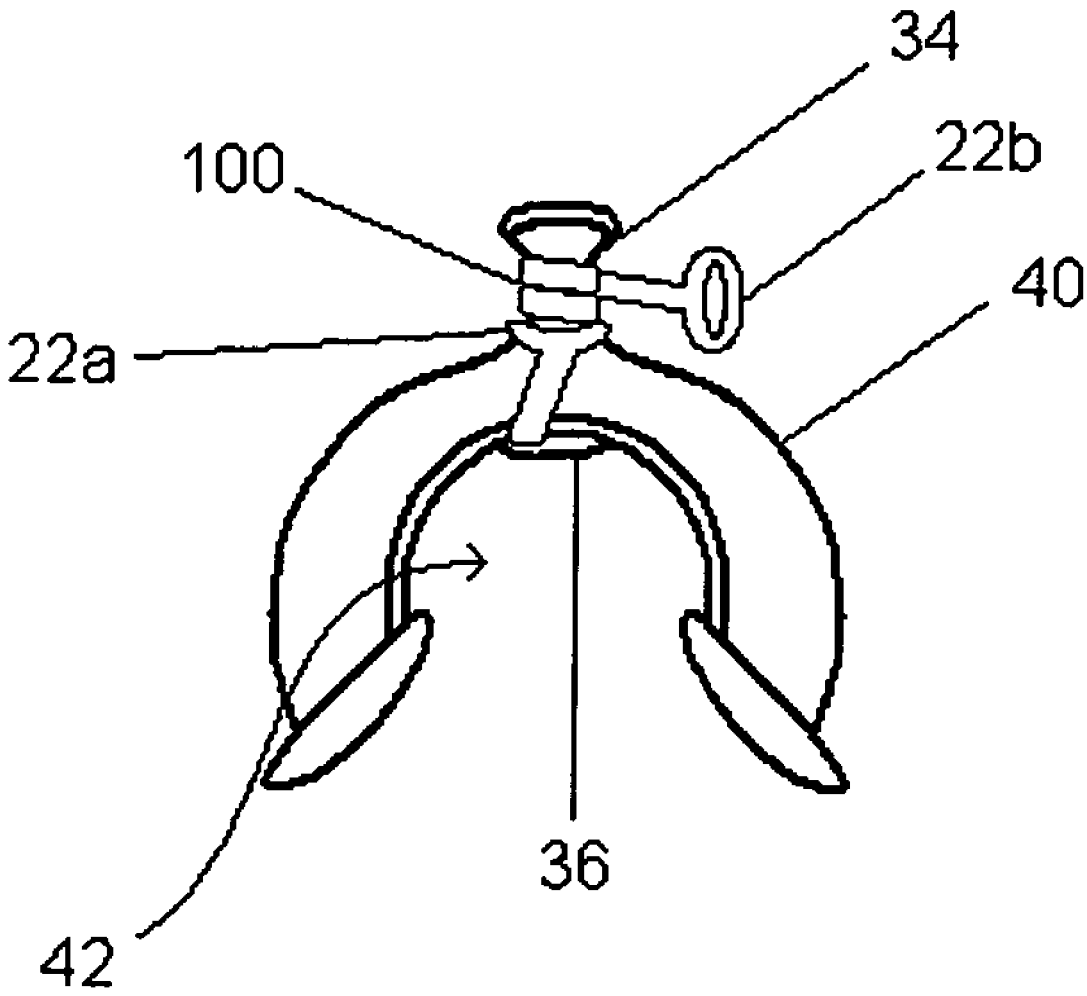
FIG. 7*c*. is a front elevation view of a saddle, and illustrating the present invention being applied to the saddle horn.

FIG. 7C illustrates the horn wrap 100 further applied to the horn 34. In this figure, the horn wrap 100 has been attached to the horn 34 via the first bell attachment piece 22A. The horn wrap 100 has been wrapped around the pommel 40 through the gullet 42 and the gullet slot 36. It has then been wrapped around the horn 34 in an even layering of the strap 10. The second tip 26*b* can now be extended through the gullet slot 36 around the pommel 40 and through the gullet 42, then applied around the horn cap 32 and anchored about the horn 34. Applied in this manner, the horn wrap 100 presents a smooth surface on the horn 34 about which dally wraps may be taken. The smooth surface allows for virtually one hundred percent contact of the rope 44 to the horn wrap 100. This allows for greater friction to be applied by the horn wrap 100 to the rope 44 helping to stop the animal at the end of rope 44. Because both either of the first or second attachment pieces may be applied to the saddle horn 34 first, the horn wrap 100 may be used in orientation until such time as it becomes scorched and the rider wishes to remove it, flip it over and attach it as in a second orientation using the opposite attachment piece for the first attachment to the horn 34. Likewise, the double strap bevel 12 allows for this secondary use as well. The horn wrap 100 and its first and second bell attachment pieces 22*a* and 22*b* act to protect both the horn 34 and the pommel 40. The horn wrap 100 is easier to apply than traditional wraps because of the attachment pieces built into the horn wrap 100 itself. Further, because of the smooth, even layers of the horn wrap 100 as it is applied to the horn 34, the horn wrap 100 enjoys a comparatively longer useful life.

Finally, the width of the strap 10 can be varied. A narrow strap 10 width allows for many turns by the strap 10 about the horn 34, whereas a wider strap 10 width provides for quick application and only a few turns about the horn 34.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

I claim:

1. An apparatus for protecting a saddle horn from friction applied by a rope comprising:

a strap, said strap being elongated and said strap having a first width;

a first attachment piece attached to said strap at a first end of said strap, said first attachment piece having a second width;

an aperture through said first attachment piece, wherein said aperture, when in use, fits around said saddle horn; and wherein said strap and said first attachment piece are elastic in nature a second attachment piece attached to said strap at a second end of said strap, said second attachment piece having a third width; wherein said third width is wider than said first width; and an aperture through said second attachment piece, wherein said aperture, when in use, fits around said saddle horn; and wherein said second attachment piece is elastic in nature.

2. The apparatus of claim 1, wherein said second width is wider than said first width.

3. The apparatus of claim 2, wherein said first attachment piece is one of a generally circular, oval, bell, square, or rectangular shape.

4. The apparatus of claim 3, wherein said strap comprises:

a strap center;

a strap bevel adjoining said strap center at a shoulder;

and a strap edge at the edge of said strap bevel opposite said shoulder, wherein said strap center has a first thickness, and said strap bevel has a decreasing thickness from said shoulder to said strap edge.

5. The apparatus of claim 3, wherein said first and second attachment pieces have curvature axes running perpendicular to said strap in the same plane as the width of said strap and generally through said apertures of each said attachment pieces, and wherein said first and second attachment pieces are curved about said curvature axes.

6. The apparatus of claim 2, wherein said strap comprises:

a strap center;

a strap bevel adjoining said strap center at a shoulder;

and a strap edge at the edge of said strap bevel opposite said shoulder, wherein said strap center has a first thickness, and said strap bevel has a decreasing thickness from said shoulder to said strap edge.

7. The apparatus of claim 2, wherein said first attachment piece has a curvature axis running perpendicular to said strap in the same plane as the width of said strap and generally through said aperture, and wherein said first attachment piece is curved about said curvature axis.

8. The apparatus of claim 1, wherein said strap comprises:

a strap center;

a strap bevel adjoining said strap center at a shoulder;

and a strap edge at the edge of said strap bevel opposite said shoulder, wherein said strap center has a first thickness, and said strap bevel has a decreasing thickness from said shoulder to said strap edge.

9. The apparatus of claim 1, wherein said first and second attachment pieces are of a generally circular, oval, bell, square, or rectangular shape.

10. The apparatus of claim 1, wherein said first attachment piece has a curvature axis running perpendicular to said strap in the same plane as the width of said strap and generally through said aperture, and wherein said first attachment piece is curved about said curvature axis.

11. The apparatus of claim 1, wherein said first width and said second width are equal.

* * * * *